US006769422B2

(12) United States Patent
Ohkuma

(10) Patent No.: US 6,769,422 B2
(45) Date of Patent: Aug. 3, 2004

(54) APPARATUS AND METHOD FOR CONTROLLING AIR-FUEL RATIO OF ENGINE

(75) Inventor: Shigeo Ohkuma, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 81 days.

(21) Appl. No.: 10/160,124

(22) Filed: Jun. 4, 2002

(65) Prior Publication Data

US 2002/0179071 A1 Dec. 5, 2002

(30) Foreign Application Priority Data

Jun. 4, 2001 (JP) ..... 2001-168135

(51) Int. Cl.[7] ..... F02D 41/14
(52) U.S. Cl. ..... 123/696; 701/109
(58) Field of Search ..... 123/696, 695, 123/694, 693, 681; 701/109

(56) References Cited

U.S. PATENT DOCUMENTS 4,917,067 A 4/1990 Yoshida
4,922,429 A * 5/1990 Nakajima et al. ..... 701/109
5,363,831 A * 11/1994 Tomisawa et al. ..... 123/695
5,394,856 A * 3/1995 Furuya ..... 123/681
5,435,290 A 7/1995 Gopp et al.
5,778,866 A * 7/1998 Uchikawa ..... 123/682
6,481,427 B1 * 11/2002 Javaherian ..... 123/673

FOREIGN PATENT DOCUMENTS

| | | |
|---|---|---|
| DE | 198 60 463 A1 | 7/2000 |
| JP | 7-127505 | 5/1995 |
| JP | 11-326266 | 11/1999 |

* cited by examiner

*Primary Examiner*—Tony M. Argenbright
*Assistant Examiner*—Hyder Ali
(74) *Attorney, Agent, or Firm*—Foley & Lardner LLP

(57) ABSTRACT

When an output signal from an oxygen sensor is within a predetermined range including a value equivalent to a stoichiometric air-fuel ratio, the output signal is converted into air-fuel ratio data, to compute an air-fuel ratio control signal based on a deviation between the air-fuel ratio data and a target air-fuel ratio. When the output signal from the oxygen sensor is outside the predetermined range, it is judged based on the output signal whether an actual air-fuel ratio is richer or leaner than the target air-fuel ratio, to compute the air-fuel ratio control signal based on the judgment result.

17 Claims, 4 Drawing Sheets

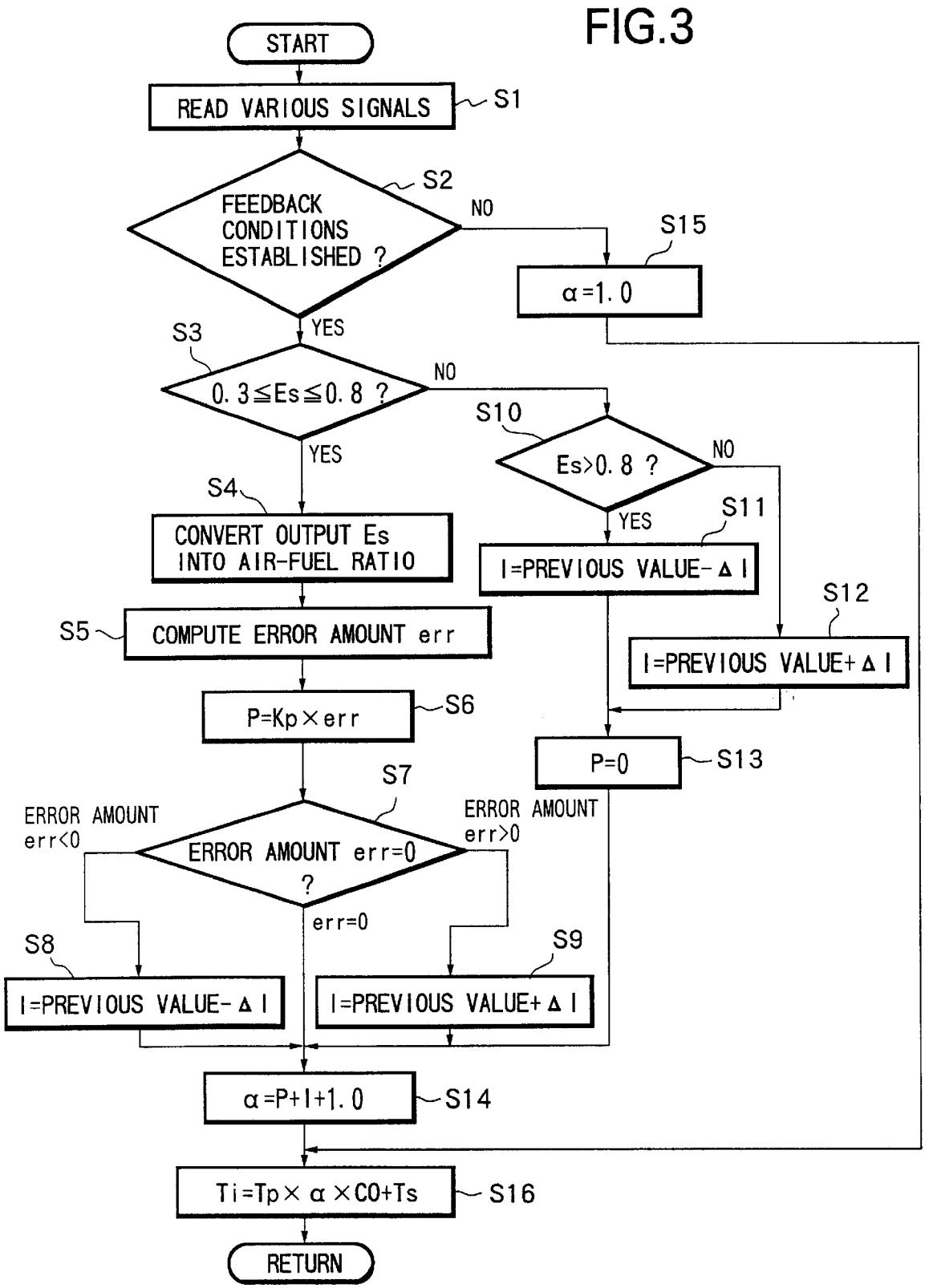
FIG.3
START
READ VARIOUS SIGNALS
S1
FEEDBACK CONDITIONS ESTABLISHED ?
S2
NO
S15
α=1.0
YES
S3
0.3≦Es≦0.8 ?
NO
S10
Es>0.8 ?
NO
YES
S11
I=PREVIOUS VALUE-ΔI
YES
S4
CONVERT OUTPUT Es INTO AIR-FUEL RATIO
S12
I=PREVIOUS VALUE+ΔI
S5
COMPUTE ERROR AMOUNT err
P=Kp×err
S6
P=0
S13
S7
ERROR AMOUNT err<0
ERROR AMOUNT err>0
ERROR AMOUNT err=0 ?
err=0
S8
I=PREVIOUS VALUE-ΔI
S9
I=PREVIOUS VALUE+ΔI
α=P+I+1.0
S14
Ti=Tp×α×CO+Ts
S16
RETURN

APPARATUS AND METHOD FOR CONTROLLING AIR-FUEL RATIO OF ENGINE

FIELD OF THE INVENTION

The present invention relates to an apparatus and a method for computing an air-fuel ratio control signal based on an output signal from an oxygen sensor that detects oxygen concentration in exhaust gas, for example, in an engine for a vehicle.

RELATED ART OF THE INVENTION

Heretofore, there has been known an air-fuel ratio control apparatus provided with an oxygen sensor from which output signal is changed in response to oxygen concentration in exhaust gas, for computing an air-fuel ratio control signal based on the oxygen sensor.

In an air-fuel ratio control apparatus disclosed in Japanese Unexamined Patent Publication No. 7-127505, an output signal from the oxygen sensor is converted into data of air-fuel ratio to obtain an actual air-fuel ratio, and an air-fuel ratio control signal is feedback controlled based on a deviation (error amount) between the actual air-fuel ratio and a stoichiometric air-fuel ratio being a target air-fuel ratio.

However, in such an oxygen sensor, while an output is abruptly changed in the vicinity of the stoichiometric air-fuel ratio, in a region apart from the stoichiometric air-fuel ratio, a change in sensor output relative to a change in air-fuel ratio becomes less since a change in oxygen concentration is small. Therefore, conversion accuracy into air-fuel ratio data is largely degraded even in a small variation of sensor output.

Consequently, in a rich or lean region where the air-fuel ratio is largely deviated from the stoichiometric air-fuel ratio, the error amount of air-fuel ratio is misjudged, resulting in a possibility that air-fuel ratio control performance shall be largely degraded.

SUMMARY OF THE INVENTION

The present invention has been achieved in view of the above problems, and has an object to provide an apparatus and a method for controlling an air-fuel ratio of engine that can stably converge the air-fuel ratio to a stoichiometric air-fuel ratio by an air-fuel ratio feedback control using an oxygen sensor and also can ensure stability of air-fuel ratio control even if the air-fuel ratio is largely deviated from the stoichiometric air-fuel ratio.

To achieve the above object, the present invention is constructed such that, when an output signal from an oxygen sensor is within a predetermined range including a value equivalent to a stoichiometric air-fuel ratio, the output signal is converted into air-fuel ratio data, to compute an air-fuel ratio control signal based on a deviation between the air-fuel ratio data and a target air-fuel ratio, while when the output signal from the oxygen sensor is outside the predetermined range, it is judged whether an actual air-fuel ratio is richer or leaner than the target air-fuel ratio based on the output signal, to compute the air-fuel ratio control signal based on the judgment result.

The other objects and features of this invention will become understood from the following description with reference to the accompanying drawings.

BRIEF EXPLANATION OF THE DRAWINGS

FIG. 3 is a flowchart showing an air-fuel ratio feedback control.

PREFERRED EMBODIMENTS

Figure 1:
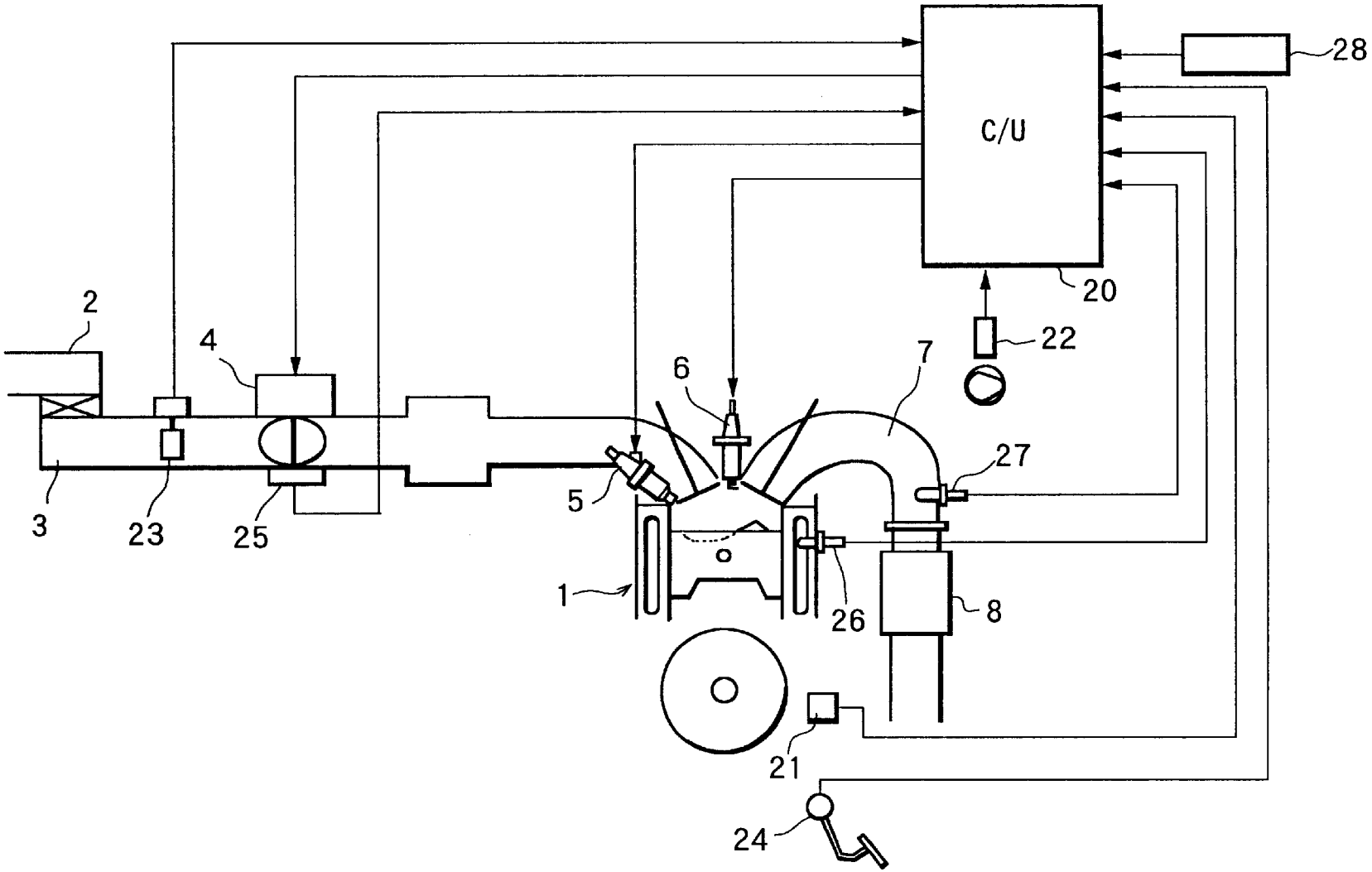
FIG. 1 is a diagram showing a system structure of an engine.

FIG. 1 is a diagram showing a system structure of an engine in an embodiment.

In FIG. 1, air is sucked into a combustion chamber of each cylinder in an engine 1 installed on a vehicle via an air cleaner 2, an intake pipe 3, and a throttle valve 4 driven to open or close by a motor.

There is provided an electromagnetic type fuel injection valve 5 for directly injecting fuel (gasoline) into the combustion chamber of each cylinder.

Air-fuel mixture is formed in the combustion chamber by the fuel injected from fuel injection valve 5 and the intake air.

Injection timing and an injection quantity of fuel injection valve 5 are controlled by an air-fuel ratio control signal output from a control unit 20.

The air-fuel mixture formed in the combustion chamber is ignited to burn by an ignition plug 6.

Note, fuel injection valve 5 may be the one injecting fuel into an intake port.

Exhaust gas from engine 1 is discharged from an exhaust pipe 7.

A catalytic converter 8 for exhaust purification is disposed in exhaust pipe 7.

Catalytic converter 8 is a three-way catalyst for oxidizing carbon monoxide CO and hydrocarbon HC, and also reducing nitrogen oxide NOx, which are harmful three components in exhaust gas.

Purification by catalytic converter 8 is performed most efficiently when an air-fuel ratio is a stoichiometric air-fuel ratio. If the air-fuel ratio is lean and an oxygen amount is excessive, oxidation becomes active but reduction becomes inactive. On the contrary, if the air-fuel ratio is rich and the oxygen amount is less, oxidation becomes inactive but reduction becomes active.

Control unit 20 is equipped with a microcomputer including a CPU, a ROM, a RAM, an A/D converter, an input/output interface and so forth.

Control unit 20 receives signals from various sensors, and by computation processes based on these signals, controls an opening degree of throttle valve 4, the injection quantity and injection timing of fuel injection valve 5, ignition timing of ignition plug 6.

The various sensors include a crank angle sensor 21 detecting a crank angle of engine 1 and a cam sensor 22 taking a cylinder discrimination signal out of a camshaft.

An engine rotation speed Ne is calculated based on a signal from crank angle sensor 21.

In addition, there is provided an airflow meter 23 detecting an intake air amount Q, an acceleration sensor 24 detecting a depressed amount of an accelerator pedal (not shown in the figure), a throttle sensor 25 detecting the opening degree of throttle valve 4, a water temperature sensor 26 detecting a cooling water temperature Tw, an oxygen sensor 27 from which output signal is changed in response to oxygen concentration in the exhaust gas, and a vehicle speed sensor 28 detecting a vehicle speed.

Oxygen sensor 27 is a known sensor disclosed in Japanese Unexamined Patent Publication No. 11-326266.

Oxygen sensor 27 includes a zirconia tube disposed to project into the exhaust pipe, and generates an electromotive force corresponding to a ratio between the oxygen concentration in the exhaust gas outside the zirconia tube and the oxygen concentration in the atmosphere inside the zirconia tube.

Figure 2:
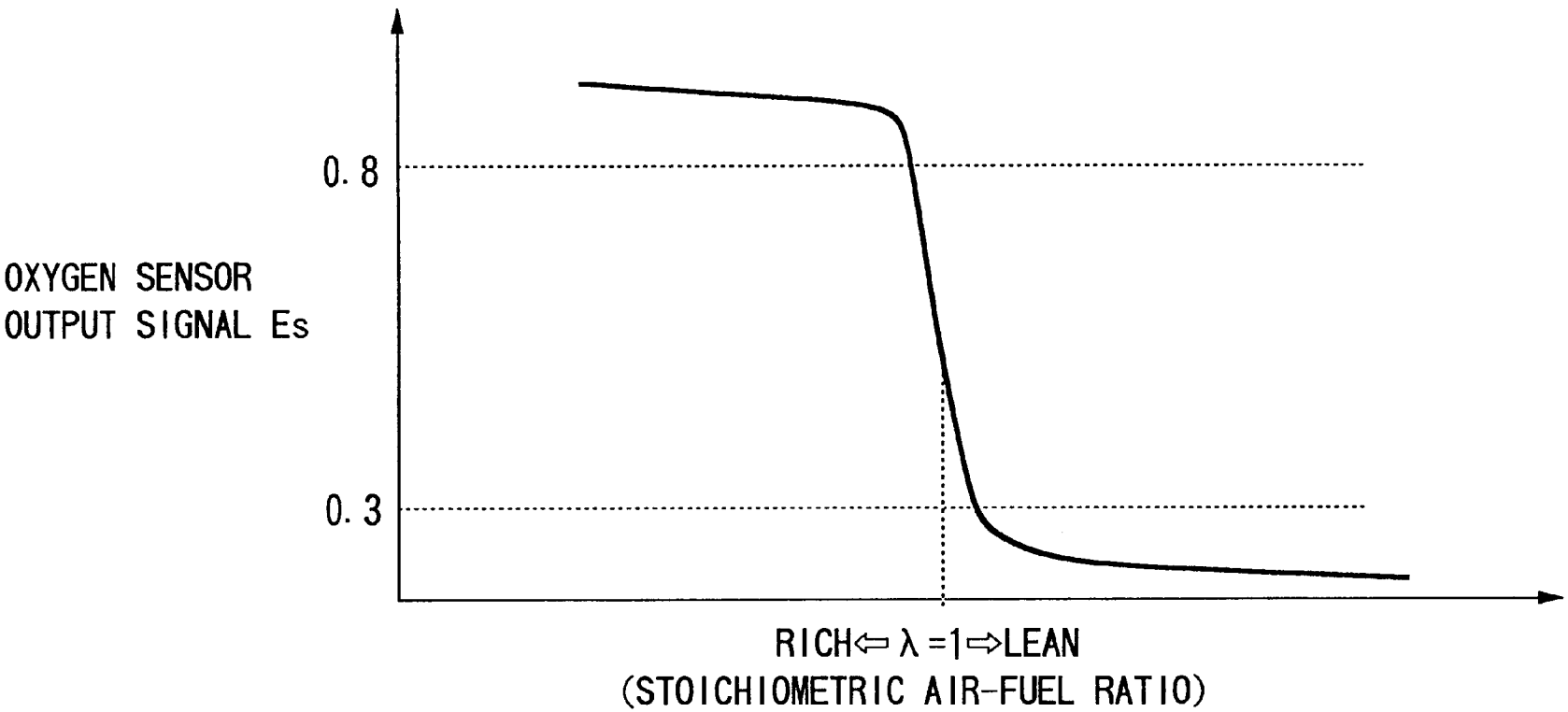
FIG. 2 is a graph showing output characteristics of oxygen sensor.

As shown in FIG. 2, an output signal Es (electromotive force) from oxygen sensor 27 has characteristics in that the electromotive force is abruptly changed on the border of the stoichiometric air-fuel ratio, and becomes high on the richer side than the stoichiometric air-fuel ratio while becoming low on the leaner side than the stoichiometric air-fuel ratio. Here, a protective layer, catalyst layer and zirconia tube constituting a sensor element are formed, so that the output signal Es is gently changed in the vicinity of stoichiometric air-fuel ratio.

Oxygen sensor 27 is not limited to such an oxygen sensor using the zirconia tube.

When air-fuel ratio feedback control conditions are established, control unit 20 feedback controls an air-fuel ratio control signal, so that an actual air-fuel ratio detected based on the output signal from oxygen sensor 27 coincides with the stoichiometric air-fuel ratio.

Details of the air-fuel ratio feedback control will be described in accordance with a flowchart of FIG. 3.

In step S1, the output signal Es from oxygen sensor 27, the cooling water temperature Tw, the engine rotation speed Ne, the intake air amount Q and so on are read in.

In step S2, it is judged whether or not the air-fuel ratio feedback control conditions are established.

As the air-fuel ratio feedback control conditions, it is judged whether or not the cooling water temperature Tw is a predetermined temperature or above, whether or not the engine load and rotation speed are within a predetermined region and so on.

If the air-fuel ratio feedback control conditions are established, control proceeds to step S3.

In step S3, it is judged whether or not the output signal Es from oxygen sensor 27 is within a predetermined range.

The predetermined range is a range including a value equivalent to the stoichiometric air-fuel ratio of sensor output, and also a region where a change in the output signal Es is comparatively abrupt relative to a change in air-fuel ratio.

In other words, the predetermined range is a region in the vicinity of stoichiometric air-fuel ratio, except for a region where the air-fuel ratio is richer or leaner than the stoichiometric air-fuel ratio and the output signal Es is not practically changed relative to the change in air-fuel ratio.

Note, in the present embodiment using oxygen sensor 27 having the output characteristics shown in FIG. 2, the predetermined range is set to a region of 0.3 (V)≦Es≦0.8 (V).

If it is judged in step S3 that the output signal Es from oxygen sensor 27 is within the predetermined range, control proceeds to step S4.

In step S4, a conversion process of the output signal Es from oxygen sensor 27 into air-fuel ratio data is executed.

The above conversion process is executed using a table indicating the correlation of the output signal Es with the air-fuel ratio.

Also, in order to further improve resolution of the conversion, after substituting the output signal Es with another variable based on a preset formula, the air-fuel ratio data may be obtained from the variable.

In step S5, a deviation between the actual air-fuel ratio obtained from the output signal Es and the stoichiometric air-fuel ratio being a target air-fuel ratio, is computed as an error amount "err".

In the present embodiment, the actual air-fuel ratio is obtained as an excess air rate λ. In step S5, an excess air rate 1.0 equivalent to the stoichiometric air-fuel ratio is subtracted from the excess air rate λ obtained from the output signal Es, and the subtraction result is set to the error amount "err".

In step S6, a proportional operation amount P is computed by multiplying the error amount "err" by a proportional constant Kp.

$$P=err\times Kp$$

By a proportional control based on the error amount "err", it is possible to promptly converge the actual air-fuel ratio to the stoichiometric air-fuel ratio when the actual air-fuel ratio becomes around the stoichiometric air-fuel ratio.

In step S7, it is judged whether the error amount "err" is positive or negative, to judge whether the actual air-fuel ratio is richer or leaner than the stoichiometric air-fuel ratio.

Specifically, if the error amount "err" is positive, it is judged that the actual air-fuel ratio is leaner than the stoichiometric air-fuel ratio. Whereas, if the error amount "err" is negative, it is judged that the actual air-fuel ratio is richer than the stoichiometric air-fuel ratio. Further, if the error amount "err" is approximately zero, it is judged that the actual air-fuel ratio approximately coincides with the stoichiometric air-fuel ratio.

Figure 4:
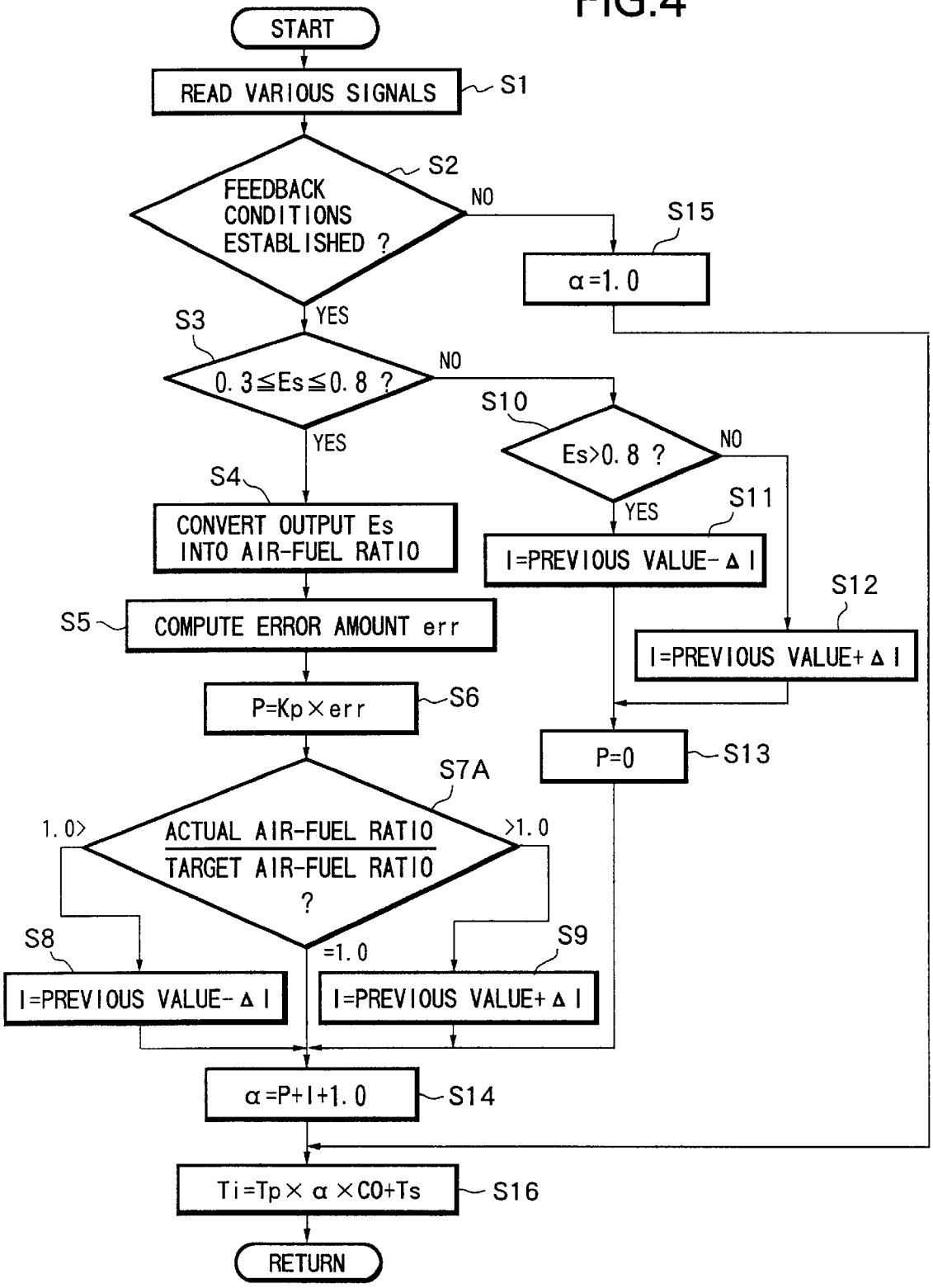
FIG. 4 is a flowchart showing an air-fuel ratio feedback control in which a rich or lean judging method is different from that of the flowchart in FIG. 3.

Note, as shown in step S7A of a flowchart in FIG. 4, the construction may be such that, if a ratio between the actual air-fuel ratio and the stoichiometric air-fuel ratio is larger than 1.0, it is judged that the actual air-fuel ratio is leaner than the stoichiometric air-fuel ratio, whereas if the ratio is smaller than 1.0, it is judged that the actual air-fuel ratio is richer than the stoichiometric air-fuel ratio.

If it is judged that the actual air-fuel ratio is richer than the stoichiometric air-fuel ratio, control proceeds to step S8.

In step S8, a result obtained by subtracting a predetermined value ΔI from a previous value of an integral operation amount I is set to a present integral operation amount I.

If it is judged in step S7 that the actual air-fuel ratio is leaner than the stoichiometric air-fuel ratio, control proceeds to step S9.

In step S9, a result obtained by adding the predetermined value ΔI to the previous value of the integral operation amount I is set to the present integral operation amount I.

Further, if it is judged in step S7 that the actual air-fuel ratio approximately coincides with the stoichiometric air-fuel ratio, control proceeds to step S14 bypassing steps S8 and S9. In this case, the integral operation amount I is held at the previous value.

In step S14, an air-fuel ratio feedback correction coefficient α is calculated as;

$$\alpha=P+I+1.0.$$

On the contrary, if it is judged in step S3 that the output signal Es from oxygen sensor 27 is outside the predetermined range (0.3 (V)>Es or Es>0.8 (V)), control proceeds to step S10.

If step S10, it is judged whether or not the output signal Es from oxygen sensor 27 is deviated to the side higher than the predetermined range. Specifically, it is judged whether or not Es>0.8 (V), to judge whether or not the actual air-fuel ratio is richer than the stoichiometric air-fuel ratio.

If it is judged in step S10 that Es>0.8 (V) and the actual air-fuel ratio is richer than the stoichiometric air-fuel ratio, control proceeds to step S11.

In step S11, a result obtained by subtracting the predetermined value ΔI from the previous value of the integral operation amount I is set to the present integral operation amount I.

Whereas, if it is judged in step S10 that the output signal is not Es>0.8 (V), since 0.3 (V)>Es, the control status is proceeded from step S3 to step S10 and it is judged that the actual air-fuel ratio is leaner than the stoichiometric air-fuel ratio.

In this case, control proceeds to step S12, where a result obtained by adding the predetermined value ΔI to the previous value of the integral operation amount I is set to the present integral operation amount I.

When the setting of integral operation amount I is performed in steps S11 and S12, zero is set to the proportional operation amount P in next step S13.

When the output signal Es from oxygen sensor 27 is within the predetermined range (0.3 (V)≦Es≦0.8 (V)), it is possible to accurately convert the output signal Es into the air-fuel ratio data. However, if the output signal Es is outside the predetermined range, since the output signal Es is not practically changed relative to the change in air-fuel ratio, it is impossible to obtain correctly the air-fuel ratio. Therefore, a proportional control based on the error amount is prohibited, to avoid that the air-fuel ratio is controlled based on an erroneous error amount.

However, even in the case where the output signal Es is outside the predetermined range, since the rich or lean judgment relative to the stoichiometric air-fuel ratio can be accurately executed, the integral control based on the rich or lean judgment is executed as in the case where the output signal Es is within the predetermined range.

Accordingly, if control proceeds to step S14 when the output signal Es is outside the predetermined range, the air-fuel ratio feedback correction coefficient α is calculated as α=I+1.0.

If it is judged in step S2 that the air-fuel ratio feedback control conditions are not established, control proceeds to step S15, where 1.0 is set to the air-fuel ratio feedback correction coefficient α.

In step S16, a fuel injection quantity Ti is calculated using the air-fuel ratio feedback correction coefficient α.

$$Ti=Tp\times\alpha\times CO+Ts$$

wherein Tp is a basic fuel injection quantity calculated from the intake air amount and engine rotation speed, CO is various correction coefficients calculated based on the cooling water temperature and the like, and Ts is correction component based on a battery voltage being a power source of fuel injection valve 5.

The air-fuel ratio control signal having a pulse width corresponding to the fuel injection quantity Ti (injection pulse signal) is output to fuel injection valve 5 in predetermined injection timing, so that fuel injection valve 5 is driven to open for a time period proportional to the fuel injection quantity Ti.

Note, the construction may be such that the proportional and integral controls are added with a derivative control obtaining a derivative value of the error amount "err" to compute a derivative operation amount D corresponding to the derivative value, when the output signal Es is within the predetermined range. In this case, if the output signal Es is outside the predetermined range, the derivative operation amount D is set to zero, to set the air-fuel ratio feedback control coefficient α.

The entire contents of Japanese Patent Application No. 2001-168135, filed Jun. 4, 2001, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

What is claimed is:

1. An air-fuel ratio control apparatus of an engine, comprising:

an oxygen sensor from which output signal is changed in response to oxygen concentration in exhaust gas of said engine;

a fuel injection valve that injects fuel to the engine based on an air-fuel ratio control signal; and a control unit that inputs with an output signal from the oxygen sensor and computes said air-fuel ratio control signal based on the output signal, to output the air-fuel ratio control signal to said fuel injection valve, wherein said control unit converts the output signal into air-fuel ratio data, to compute the air-fuel ratio control signal based on a deviation between said air-fuel ratio data and a target air-fuel ratio, when the output signal from the oxygen sensor is within a predetermined range including a value equivalent to a stoichiometric air-fuel ratio; and judges whether or not an actual air-fuel ratio is richer or leaner than the target air-fuel ratio based on the output signal, to compute the air-fuel ratio control signal based on said judgment result, when the output signal from the oxygen sensor is outside said predetermined range.

2. An air-fuel ratio control apparatus of an engine according to claim 1, wherein said control unit includes an integral control determining an increase or decrease direction of the air-fuel ratio control signal corresponding to the richer or leaner judgment result to change an integral operation amount for correcting the air-fuel ratio control signal corresponding to said determination by each predetermined value, to compute the air-fuel ratio control signal, when the output signal from the oxygen sensor is outside the predetermined range.

3. An air-fuel ratio control apparatus of an engine according to claim 1, wherein said control unit includes a proportional control computing a proportional operation amount for correcting the air-fuel ratio control signal based on said air-fuel ratio deviation and a proportional constant, to compute the air-fuel ratio control signal, when the output signal from the oxygen sensor is within the predetermined range.

4. An air-fuel ratio control apparatus of an engine according to claim 1, wherein said control unit computes the air-fuel ratio signal, by a proportional control computing a proportional operation amount for correcting the air-fuel ratio control signal based on said air-fuel ratio deviation and a proportional constant, and by an integral control determining an increase or decrease direction of the air-fuel ratio control signal corresponding to the richer or leaner of the air-fuel ratio data to the target air-fuel ratio to change an integral operation amount for correcting the air-fuel ratio control signal corresponding to said determination by each predetermined value, when the output signal from the oxygen sensor is within the predetermined range.

5. An air-fuel ratio control apparatus of an engine according to claim 4, wherein said control unit judges whether the air-fuel ratio data is richer or leaner than the target air-fuel ratio corresponding to whether the deviation between the air-fuel ratio data and the target air-fuel ratio is positive or negative.

6. An air-fuel ratio control apparatus of an engine according to claim 4, wherein said control unit judges whether the air-fuel ratio data is richer or leaner than the target air-fuel ratio corresponding to a ratio between the air-fuel ratio data and the target air-fuel ratio.

7. An air-fuel ratio control apparatus of an engine according to claim 1, wherein said control unit:

judges whether the actual air-fuel ratio is richer or leaner than the target air-fuel ratio based on the output signal from the oxygen sensor and determines an increase or decrease direction of the air-fuel ratio control signal corresponding to said judgment result, to change an integral operation amount for correcting the air-fuel ratio control signal corresponding to said determination by each predetermined value; and at the same time, computes a proportional operation amount for correcting the air-fuel ratio control signal based on the air-fuel ratio deviation and a proportional constant, when the output signal from the oxygen sensor is within the predetermined range, and sets said proportional operation amount to zero, when the output signal from the oxygen sensor is outside the predetermined range; and computes the air-fuel ratio control signal based on said integral operation amount and said proportional operation amount.

8. An air-fuel ratio control apparatus of an engine according to claim 1, wherein said oxygen sensor generates an electromotive force in proportional to a ratio between oxygen concentration in the atmosphere and the oxygen concentration in the exhaust gas, and has output characteristics in which the electromotive force is gently changed in the vicinity of the stoichiometric air-fuel ratio.

9. An air-fuel ratio control apparatus of an engine comprising:

an oxygen sensor from which output signal is changed in response to oxygen concentration in an exhaust gas of said engine;

a fuel injection valve that injects fuel to the engine based on an air-fuel ratio control signal;

first air-fuel ratio control means for converting the output signal into air-fuel ratio data, to compute the air-fuel ratio control signal based on a deviation between said air-fuel ratio data and a target air-fuel ratio, when the output signal from the oxygen sensor is within a predetermined range including a value equivalent to a stoichiometric air-fuel ratio; and second air-fuel ratio control means for judging whether or not an actual air-fuel ratio is richer or leaner than the target air-fuel ratio based on the output signal, to compute the air-fuel ratio control signal based on said judgment result, when the output signal from the oxygen sensor is outside said predetermined range.

10. An air-fuel ratio control method of an engine which comprises an oxygen sensor from which output signal is changed in response to oxygen concentration in an exhaust gas of said engine and a fuel injection valve that injects fuel to the engine based on an air-fuel ratio control signal, said method comprising the steps of:

converting the output signal into air-fuel ratio data, to compute the air-fuel ratio control signal based on a deviation between said air-fuel ratio data and a target air-fuel ratio, when the output signal from the oxygen sensor is within a predetermined range including a value equivalent to a stoichiometric air-fuel ratio; and judging whether or not an actual air-fuel ratio is richer or leaner than the target air-fuel ratio based on the output signal, to compute the air-fuel ratio control signal based on said judgment result, when the output signal from the oxygen sensor is outside said predetermined range.

11. An air-fuel ratio control method of an engine according to claim 10, wherein said step of computing the air-fuel ratio control signal when the output signal from the oxygen sensor is outside the predetermined range comprises the step of:

determining an increase or decrease direction of the air-fuel ratio control signal corresponding to the richer or leaner judgment result to change an integral operation amount for correcting the air-fuel ratio control signal corresponding to said determination by each predetermined value.

12. An air-fuel ratio control method of an engine according to claim 10, wherein said step of computing the air-fuel ratio control signal when the output signal from the oxygen sensor is within the predetermined range comprises the step of:

computing a proportional operation amount for correcting the air-fuel ratio control signal based on said air-fuel ratio deviation and a proportional constant.

13. An air-fuel ratio control method of an engine according to claim 10, wherein said step of computing the air-fuel ratio control signal when the output signal from the oxygen sensor is within the predetermined range comprises the steps of:

computing a proportional operation amount for correcting the air-fuel ratio control signal based on said air-fuel ratio deviation and a proportional constant; and determining an increase or decrease direction of the air-fuel ratio control signal corresponding to the richer or leaner of the air-fuel ratio data to the target air-fuel ratio, to change an integral operation amount for correcting the air-fuel ratio control signal corresponding to said determination by each predetermined value.

14. An air-fuel ratio control method of an engine according to claim 13, wherein said step of computing the integral operation amount comprises the step of:

judging whether the air-fuel ratio data is richer or leaner than the target air-fuel ratio corresponding to whether the deviation between the air-fuel ratio data and the target air-fuel ratio is positive or negative.

15. An air-fuel ratio control method of an engine according to claim 13, wherein said step of computing the integral operation amount comprises the step of:

judging whether the air-fuel ratio data is richer or leaner than the target air-fuel ratio corresponding to a ratio between the air-fuel ratio data and the target air-fuel ratio.

16. An air-fuel ratio control method of an engine according to claim 10, wherein said method further comprises the step of judging whether the actual air-fuel ratio is richer or leaner than the target air-fuel ratio based on the output signal from the oxygen sensor and determining an increase or decrease direction of the air-fuel ratio control signal corresponding to said judgment result, to change an integral operation amount for correcting the air-fuel ratio control signal corresponding to said determination by each predetermined value, and at the same time, said step of computing the air-fuel ratio control signal when the output signal from the oxygen sensor is within the predetermined range comprises the steps of:

computing a proportional operation amount for correcting the air-fuel ratio control signal based on the air-fuel ratio deviation and a proportional constant; and computing the air-fuel ratio control signal based on said proportional operation amount and the integral operation amount, and said step of computing the air-fuel ratio control signal when the output signal from the oxygen sensor is outside the predetermined range comprises the steps of:

setting said proportional operation amount to zero; and computing the air-fuel ratio control signal based on said proportional operation amount and the integral operation amount.

17. An air-fuel ratio control method of an engine according to claim 10, wherein said oxygen sensor generates an electromotive force in proportional to a ratio between oxygen concentration in the atmosphere and the oxygen concentration in the exhaust gas, and has output characteristics in which the electromotive force is gently changed in the vicinity of the stoichiometric air-fuel ratio.

* * * * *